US009955798B1

(12) United States Patent
Lo

(10) Patent No.: US 9,955,798 B1
(45) Date of Patent: May 1, 2018

(54) PLAYPEN WITH BOTTOM SECURING STRUCTURE

(71) Applicant: Delsun Co., Ltd., Tainan (TW)

(72) Inventor: Feng-Jun Lo, Tainan (TW)

(73) Assignee: Delsun Co., Ltd., Tainan (TW)

( * ) Notice: Subject to any disclaimer, the term of this patent is extended or adjusted under 35 U.S.C. 154(b) by 0 days. days.

(21) Appl. No.: 15/593,427

(22) Filed: May 12, 2017

(51) Int. Cl.
*A47D 13/06* (2006.01)
*A47D 15/00* (2006.01)

(52) U.S. Cl.
CPC ..... *A47D 13/06* (2013.01); *A47D 15/008* (2013.01)

(58) Field of Classification Search
CPC ..... A47D 13/06; A47D 13/063; A47D 7/002; A47D 9/00; A47D 9/005
See application file for complete search history.

(56) References Cited

U.S. PATENT DOCUMENTS 2,691,177 A * 10/1954 Leonard ..... A47D 9/005 5/98.3
3,789,439 A * 2/1974 Berg ..... A47D 13/063 5/93.2
4,819,285 A * 4/1989 Fetters ..... A47D 13/063 5/99.1
5,697,111 A * 12/1997 Dillner ..... A47D 13/063 5/93.1
6,119,288 A * 9/2000 Hendrickson ..... A47D 13/063 5/97
6,182,308 B1 * 2/2001 Yang ..... A47D 7/04 24/616
7,430,770 B2 * 10/2008 Ramirez ..... A47C 21/08 5/414
7,543,342 B2 * 6/2009 Zhao ..... A47D 13/06 5/655
8,955,174 B1 * 2/2015 Lawlor ..... A47D 9/005 5/93.1
2003/0070229 A1 * 4/2003 Hsia ..... A47D 7/04 5/95
2007/0214576 A1 * 9/2007 Espenshade ..... A47D 15/003 5/723
2008/0271244 A1 * 11/2008 Bergkvist ..... A47D 13/063 5/99.1
2016/0113413 A1 * 4/2016 Chien Chen ..... A47D 7/02 5/100

* cited by examiner

*Primary Examiner* — Eric J Kurilla
(74) *Attorney, Agent, or Firm* — Alan D. Kamrath; Kamrath IP Lawfim, P.A.

(57) ABSTRACT

A playpen includes a frame, a cloth enclosure mounted on the frame and having a movement space, and a protective cushion mounted in the movement space of the cloth enclosure. The protective cushion includes at least one upper covering layer secured on the cloth enclosure, and a cushion body mounted between the at least one upper covering layer and the cloth enclosure. A receiving space is defined between the at least one upper covering layer and the cloth enclosure to receive the cushion body. Thus, when the baby is stepping and moving on the protective cushion, the at least one upper covering layer of the protective cushion will not slip on the cloth enclosure, thereby preventing the baby from falling down.

4 Claims, 4 Drawing Sheets

PLAYPEN WITH BOTTOM SECURING STRUCTURE

BACKGROUND OF THE INVENTION

1. Field of the Invention

The present invention relates to a playpen for placing a baby and, more particularly, to a playpen with a bottom securing structure.

2. Description of the Related Art

A conventional playpen in accordance with the prior art shown in FIG. 1 comprises a frame (not shown), a cloth enclosure 31 mounted on the frame and having an interior provided with a movement space 32, and a protective cushion 4 mounted in the movement space 32 of the cloth enclosure 31. The cloth enclosure 31 is provided with a first connecting strap 33 having a first buckle fastener 34. The protective cushion 4 includes an outer layer 42 and a cushion body 41 mounted in the outer layer 42. The protective cushion 4 is provided with a second connecting strap 43 having a second buckle fastener 44. In assembly, when the protective cushion 4 is placed in the movement space 32 of the cloth enclosure 31, the second buckle fastener 44 is connected with the first buckle fastener 34, so that the protective cushion 4 is assembled with the cloth enclosure 31. Thus, the protective cushion 4 provides a buffering effect to the baby when the baby falls down, thereby preventing the baby from being hurt. However, the protective cushion 4 is not secured on the cloth enclosure 31, so that when the baby is moving on the protective cushion 4, the protective cushion 4 easily slips on the cloth enclosure 31, and the baby will fall down due to slipping movement of the protective cushion 4, thereby causing danger to the baby. In addition, the cloth enclosure 31 needs to have a first connecting strap 33 having a first buckle fastener 34, and the protective cushion 4 needs to have a second connecting strap 43 having a second buckle fastener 44, thereby increasing the cost of material and time of fabrication.

BRIEF SUMMARY OF THE INVENTION

In accordance with the present invention, there is provided a playpen comprising a frame, a cloth enclosure mounted on the frame and having an interior provided with a movement space, and a protective cushion mounted in the movement space of the cloth enclosure. The protective cushion includes at least one upper covering layer secured on the cloth enclosure, and a cushion body mounted between the at least one upper covering layer and the cloth enclosure. The at least one upper covering layer is located at a bottom of the movement space. A receiving space is defined between the at least one upper covering layer and an inner side of the cloth enclosure, and the cushion body is mounted in the receiving space.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
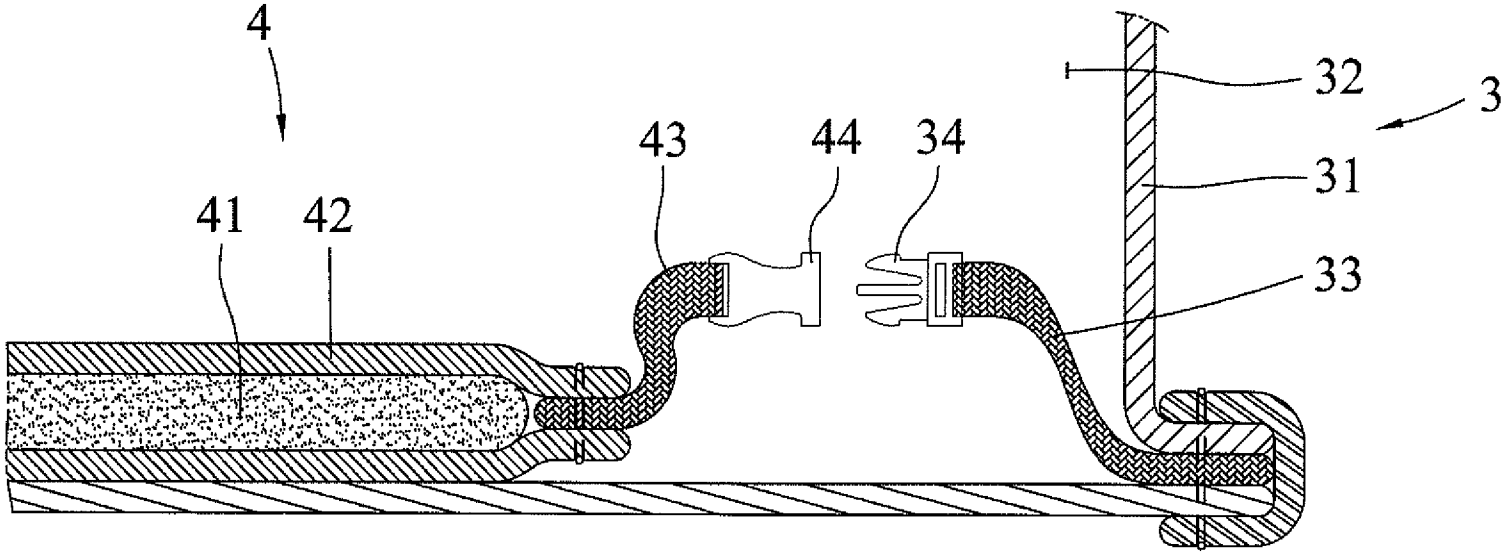
FIG. 1 PRIOR ART
FIG. 1 is a partially cross-sectional view of a conventional playpen in accordance with the prior art.
Figure 2:
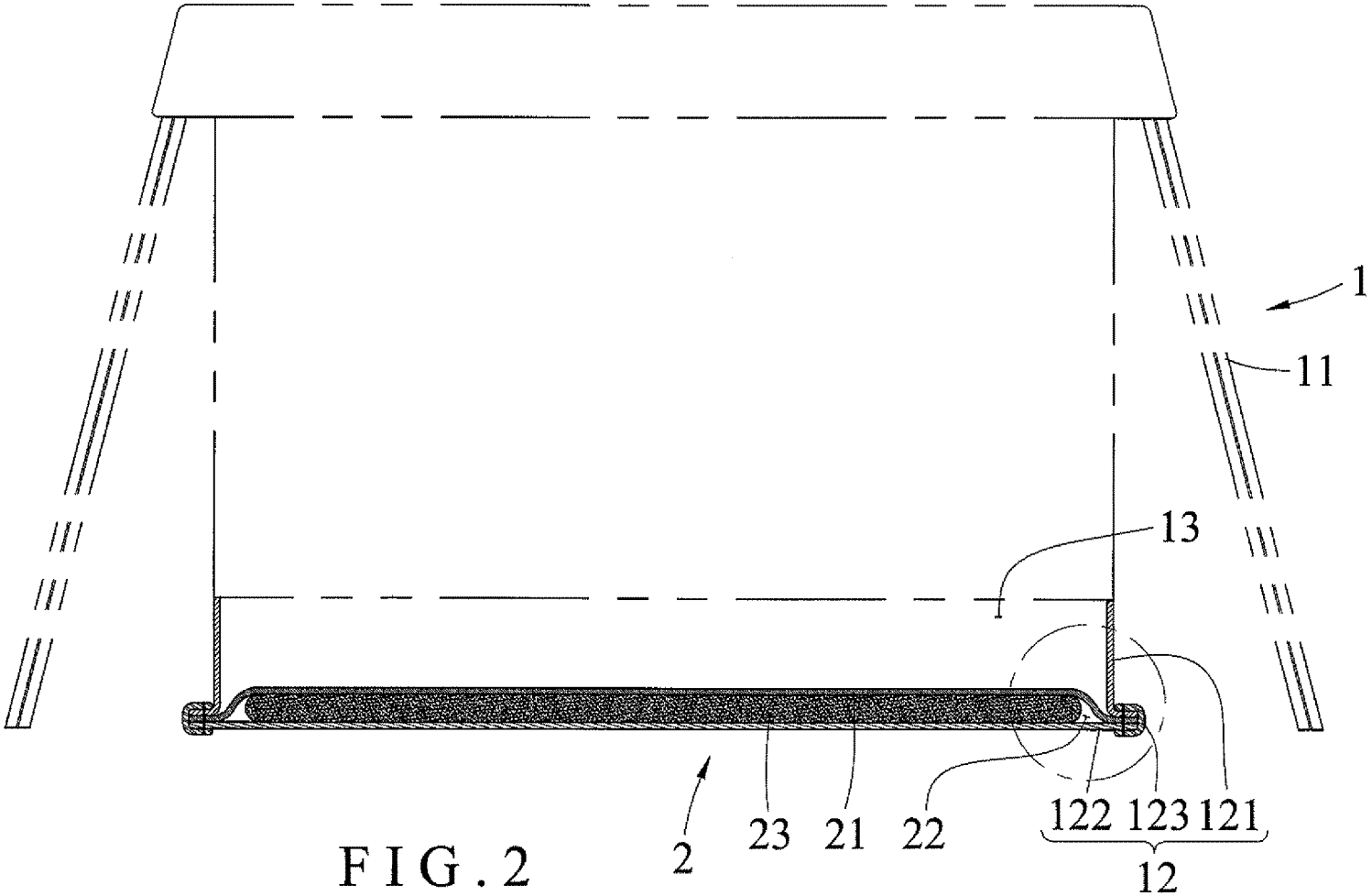
FIG. 2 is a cross-sectional view of a playpen in accordance with the preferred embodiment of the present invention.
Figure 3:
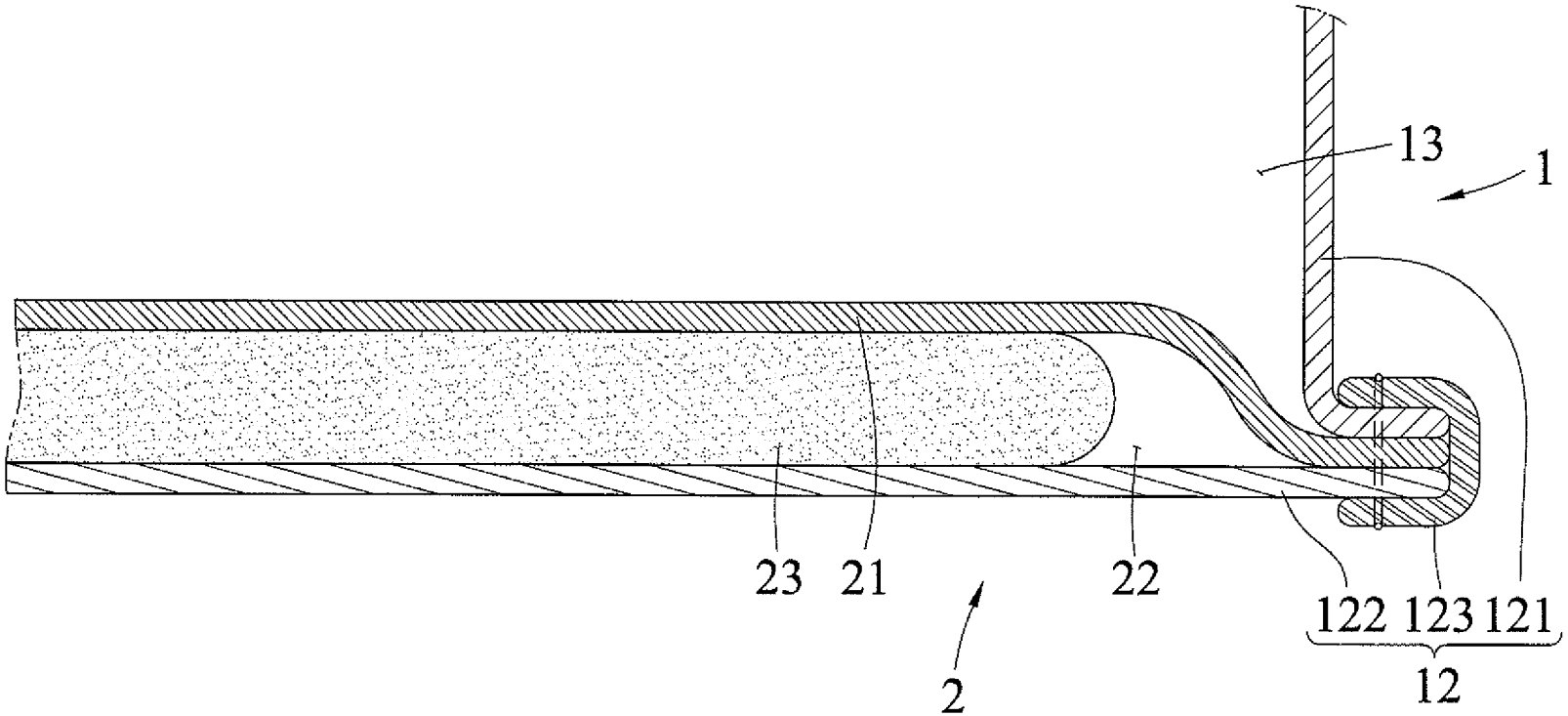
FIG. 3 is a locally enlarged view of the playpen as shown in FIG. 2.

Referring to the drawings and initially to FIGS. 2 and 3, a playpen 1 in accordance with the preferred embodiment of the present invention comprises a frame 11, a cloth enclosure 12 mounted on the frame 11 and having an interior provided with a movement space 13 to allow movement of a baby, and a protective cushion 2 mounted in the movement space 13 of the cloth enclosure 12.

The protective cushion 2 includes at least one upper covering layer 21 secured on the cloth enclosure 12, and a cushion body 23 mounted between the at least one upper covering layer 21 and the cloth enclosure 12. The at least one upper covering layer 21 is located at a bottom of the movement space 13. A receiving space 22 is defined between the at least one upper covering layer 21 and an inner side of the cloth enclosure 12, and the cushion body 23 is mounted in the receiving space 22.

In the preferred embodiment of the present invention, the cushion body 23 of the protective cushion 2 is made of soft material, such as a foam, to provide a buffering effect, and the at least one upper covering layer 21 of the protective cushion 2 is made of cloth and is sewn on the cloth enclosure 12.

In the preferred embodiment of the present invention, the cloth enclosure 12 includes a side part 121 and a bottom part 122 secured on a lower portion of the side part 121. The movement space 13 of the cloth enclosure 12 is defined between the side part 121 and the bottom part 122. The at least one upper covering layer 21 of the protective cushion 2 is secured with the side part 121 and the bottom part 122 of the cloth enclosure 12, and the receiving space 22 is defined between the at least one upper covering layer 21 and the bottom part 122 of the cloth enclosure 12. The cloth enclosure 12 further includes a reinforcement 123 mounted on an intersection of the side part 121 and the bottom part 122. The reinforcement 123 of the cloth enclosure 12 is connected with the side part 121 and the bottom part 122 to enhance the connecting strength of the side part 121 and the bottom part 122. In practice, the reinforcement 123, the lower edge of the side part 121, the edge of the at least one upper covering layer 21 and the edge of the bottom part 122 are sewn together.

In use, the at least one upper covering layer 21 of the protective cushion 2 is secured on the cloth enclosure 12, so that when the baby is moving in the movement space 13, the at least one upper covering layer 21 of the protective cushion 2 will not slip on the cloth enclosure 12 due to the baby's stepping, thereby preventing the baby from falling down. In addition, the cushion body 23 of the protective cushion 2 provides a buffering effect to protect the baby when falling down inadvertently.

Figure 4:
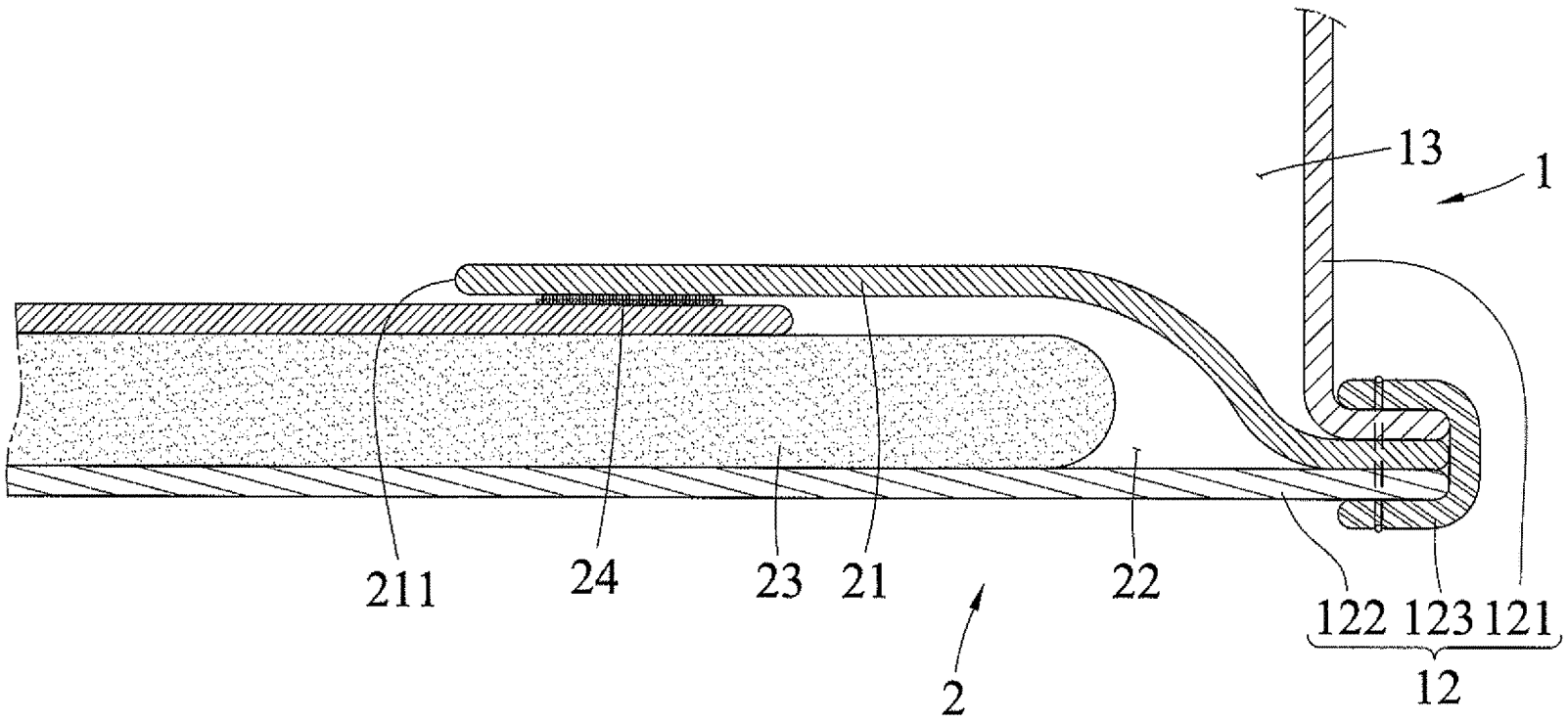
FIG. 4 is a partially cross-sectional view of a playpen in accordance with another preferred embodiment of the present invention.

Referring now to FIG. 4, the at least one upper covering layer 21 of the protective cushion 2 includes at least two free ends 211 and at least two connecting members 24 mounted on the at least two free ends 211. The at least two connecting members 24 are connected with each other. Preferably, each of the at least two connecting members 24 is a Velcro closure, a button, a snap or a zipper. When the at least two connecting members 24 are connected with each other, the at least two free ends 211 are closed, and the cushion body 23 is limited in the receiving space 22 by the at least two free ends 211. When the at least two connecting members 24 are detached from each other, the at least two free ends 211 are opened, and the cushion body 23 is removed from between the at least two free ends 211 for washing or replacement. In fabrication, the rim of the at least one upper covering layer 21 is secured on the cloth enclosure 12, and a determined position of the at least one upper covering layer 21 is provided with an opening which has two sides forming the at least two free ends 211. Then, the at least two connecting members 24 are mounted on the at least two free ends 211. In such a manner, when the opening is opened, the cushion body 23 is placed into or removed from the receiving space 22, and when the opening is closed, the cushion body 23 is limited in the receiving space 22.

Accordingly, the protective cushion 2 provides a buffering effect to protect the baby when falling down, thereby preventing the baby from being hurt. In addition, the at least one upper covering layer 21 of the protective cushion 2 is secured on the cloth enclosure 12, so that when the baby is stepping and moving on the protective cushion 2, the at least one upper covering layer 21 of the protective cushion 2 will not slip on the cloth enclosure 12, thereby preventing the baby from falling down, and enhancing the baby's safety. Further, the at least one upper covering layer 21 of the protective cushion 2 is directly secured on the cloth enclosure 12, thereby decreasing the cost of material and time of fabrication.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A playpen comprising:

a frame;

a cloth enclosure mounted on the frame and having an interior provided with a movement space; and a protective cushion mounted in the movement space of the cloth enclosure;

wherein:

the protective cushion includes at least one upper covering layer secured on the cloth enclosure, and a cushion body mounted between the at least one upper covering layer and the cloth enclosure;

the at least one upper covering layer is located at a bottom of the movement space;

a receiving space is defined between the at least one upper covering layer and an inner side of the cloth enclosure; and the cushion body is mounted in the receiving space, wherein:

the cloth enclosure includes a side part and a bottom part secured on a lower portion of the side part, the at least one upper covering layer of the protective cushion is secured with the side part and the bottom part of the cloth enclosure, and the receiving space is defined between the at least one upper covering layer and the bottom part of the cloth enclosure, and the at least one upper covering layer of the protective cushion includes at least two free ends and at least two connecting members mounted on the at least two free ends;

the at least two connecting members are connected with each other;

wherein:

when the at least two connecting members are connected with each other, the at least two free ends are closed; and when the at least two connecting members are detached from each other, the at least two free ends are opened, and the cushion body is removed from between the at least two free ends.

2. The playpen of claim 1, wherein the at least one upper covering layer of the protective cushion is sewn on the cloth enclosure.

3. The playpen of claim 1, wherein the cloth enclosure further includes a reinforcement mounted on an intersection of the side part and the bottom part, and the reinforcement of the cloth enclosure is connected with the side part and the bottom part.

4. The playpen of claim 1, wherein each of the at least two connecting members is a Velcro closure, a button, a snap or a zipper.

* * * * *